US005079561A

United States Patent [19]

Park

[11] Patent Number: 5,079,561

[45] Date of Patent: Jan. 7, 1992

[54] PLANAR ARRAY WAVEGUIDE ANTENNA WITH L-SHAPED SERIES/SERIES COUPLING SLOTS

[75] Inventor: Pyong K. Park, Agoura Hills, Calif.

[73] Assignee: Hughes Aircraft Company, Los Angeles, Calif.

[21] Appl. No.: 713,028

[22] Filed: Jun. 7, 1991

Related U.S. Application Data

[63] Continuation of Ser. No. 455,036, Dec. 22, 1989, abandoned.

[51] Int. Cl.[5] ..... H01Q 13/10

[52] U.S. Cl. ..... 343/771; 343/770; 333/113; 333/114

[58] Field of Search ..... 343/771, 767, 770; 333/113, 114, 254

[56] References Cited

U.S. PATENT DOCUMENTS

| | | | |
|---|---|---|---|
| 2,473,274 | 6/1949 | Bradley | 333/114 |
| 2,573,746 | 11/1951 | Watson et al. | 343/771 |
| 2,993,181 | 7/1961 | Friedman et al. | 333/114 |
| 3,230,483 | 1/1966 | Kinsey | 333/114 |
| 3,281,851 | 10/1966 | Goebels, Jr. | 343/771 |
| 3,537,037 | 10/1970 | Brumbaugh | 333/114 |
| 3,720,953 | 3/1973 | Ajioka | 343/771 |
| 4,303,898 | 12/1981 | Kinsey et al. | 333/254 |

*Primary Examiner*—Michael C. Wimer
*Assistant Examiner*—Hoanganh Le
*Attorney, Agent, or Firm*—C. D. Brown; R. M. Heald; W. K. Denson-Low

[57] ABSTRACT

An array antenna which includes a first waveguide 12 coupled to a second waveguide 20 by an L-shaped coupling slot 30. The slot 30 has a first portion 32 orthogonal to a second portion 34 thereof thereby providing the unique L-shape. In a specific embodiment, the slot 30 is located with the first portion 32 along the centerline and longitudinal axis of the first waveguide 12 and the second portion 34 along the centerline and longitudinal axis of the second waveguide 20. The folded short, as well as the tapered section of prior designs can be eliminated by use of the L-shaped coupling slot of the present invention in the first and last positions of the coupling slot because a short can be placed at the L-shaped slot. Hence, the L-shaped coupling slot of the present invention provides a more compact planar antenna than that afforded by conventional designs.

7 Claims, 3 Drawing Sheets

MAIN GUIDE FEED
a1
b1
a2
b2
1
2
3
4
12
20
30
32
34
12.7
d1
℄
℄

10
100
110

PLANAR ARRAY WAVEGUIDE ANTENNA WITH L-SHAPED SERIES/SERIES COUPLING SLOTS

This invention was made with Government support under Contract No. N00019-85-G-0171 awarded by the Department of the Navy. The Government has certain rights in this invention.

This is a continuation application Ser. No. 07/455,036 filed 12-22-89 now abandoned.

BACKGROUND OF THE INVENTION

1. Field of the Invention

The present invention relates to antennas. More specifically, the present invention relates to slot coupled, planar array waveguide antennas.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Planar array antennas are used for a wide variety of radar applications. A typical planar array antenna includes a linear array of coplanar radiating elements or slots in a radiating waveguide. Microwave energy is provided to the radiating waveguides by a feed waveguide running underneath the array of radiating waveguides and crosswise thereto such that there is a sharing of a section of broadwall.

Slot coupling is a frequently used technique for coupling energy from the feed waveguide to the radiating waveguides. This is illustrated in FIG. 1 which shows a typical conventional array antenna. Slot coupling involves communication of energy through a slot in a broadwall of the feed waveguide through a colocated slot in the broadwall of the radiating waveguide. Energy is typically provided to the feed waveguide by an input waveguide (not shown) located at either end of the feed waveguide or somewhere along the length thereof. In the antenna of FIG. 1, the coupling slot is centered, inclined in the common broadwall, and the radiating slots are longitudinal and offset relative thereto.

For planar antennas, the radiating slots are essentially shunt (parallel) elements. Thus, short circuit elements are placed beyond the first and last radiating elements at distance equal to one quarter the wavelength in the waveguide (at which the antenna will be operating) to terminate the radiating waveguide properly and achieve a desired radiating pattern. However, the coupling slots are series elements. Thus shorts, in the feed waveguide, must be located beyond the first and last coupling slots at distances equal to one-half the guide wavelength at which the antenna will be operating to achieve optimum, efficient output coupling and the desired radiating pattern. Hence, for proper spacing of the shorting elements, it may be necessary to lengthen the feed waveguide.

However, due to space constraints, it is often necessary to fold the ends of the feed waveguides as illustrated in FIG. 1. This adds to the weight and cost associated with planar array antennas. Further, in many cases, the folded short is implemented in a tapered waveguide section for further space savings. Unfortunately, the slot under a tapered section does not behave as a series element. Hence, the performance of such slots is difficult to predict.

Thus, there is a need in the art for an alternative to the use of folded feed waveguides which would provide a light weight, low cost slot coupled array antenna design.

SUMMARY OF THE INVENTION

The need in the art is addressed by the array antenna of the present invention which includes a first waveguide coupled to a second waveguide by an L-shaped coupling slot. The slot has a first portion orthogonal to a second portion thereof thereby providing the unique L-shape.

In a specific embodiment, the slot is located with a first portion along the centerline and longitudinal axis of the first waveguide and a second portion along the centerline and longitudinal axis of the second waveguide.

DESCRIPTION OF THE INVENTION

Illustrative embodiments and exemplary applications will now be described with reference to the accompanying drawings to disclose the advantageous teachings of the present invention.

Figure 1:
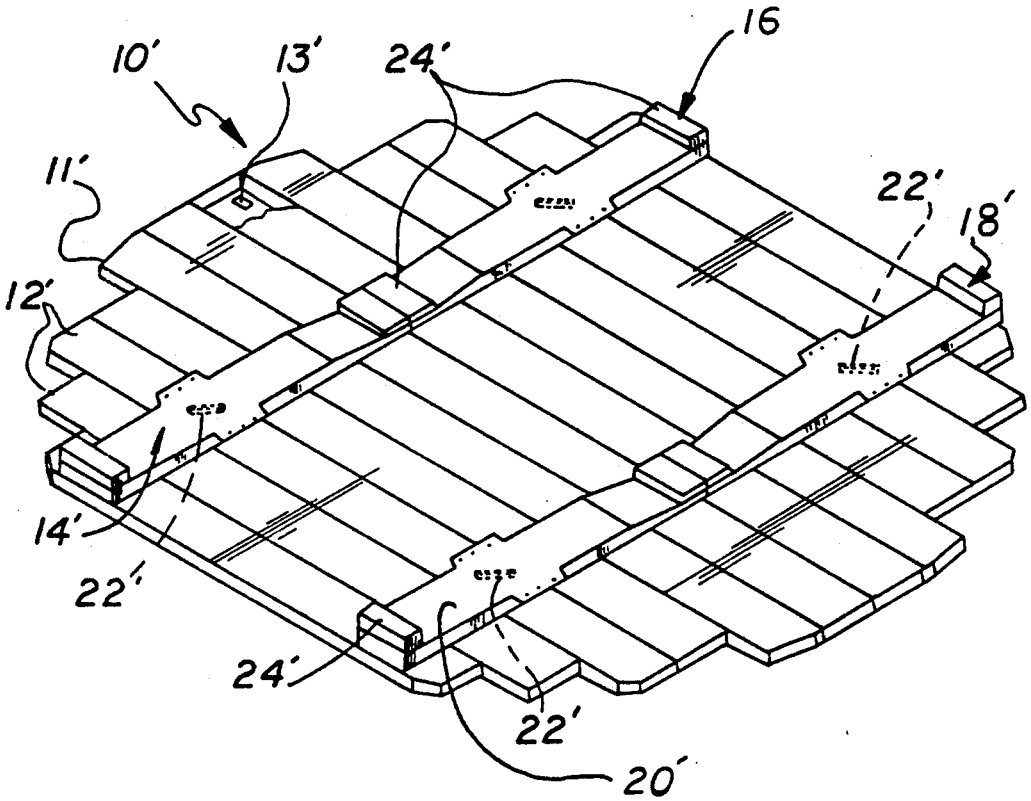
FIG. 1 PRIOR ART
FIG. 1 shows a typical conventional array antenna.

FIG. 1 shows a slot coupled planar array antenna 10' of conventional design. The antenna 10' includes an array 11' of radiating waveguides 12'. The array 11' consists of a family of rectangular waveguides 12' placed side-by-side so that neighbors share a common broadwall. The radiating waveguides 12' are fed in quadrants by feed waveguides 14', 16', 18' and 20' as is common in the art. The feed waveguides lie on top and across the radiating waveguides. Energy from the feed waveguide is radiated from the radiating waveguides by a plurality of offset longitudinal radiating slots 13'. The first and last radiating slots in a radiating guide are located at a distance of $k_g/4$ from the shorted end of the waveguide 12' to provide a proper termination, where, as used herein, $k_g$ is the wavelength of the energy inside the waveguide.

Each of the feed waveguides is coupled to the radiating waveguides by a plurality of coupling slots 22' shown in phantom. The coupling slots are tilted relative to the longitudinal axis of the guide. The feed waveguides have shorts at $k_g/2$ beyond the first and last coupling slots for proper termination. The ends of the feed waveguides are folded, as is common in the art, due to space limitations. The folded sections 24' are costly to manufacture and add to the weight of the antenna. It is an object of the present invention to eliminate the need for the folded sections of conventional slot coupled planar array antennas.

FIG. 1 also shows the taper section 26' frequently used in connection with the use of the fold 24'. It is a further object of the present invention to eliminate the need for the use of a tapered section in connection with conventional slot coupled planar array antennas.

Figure 2:
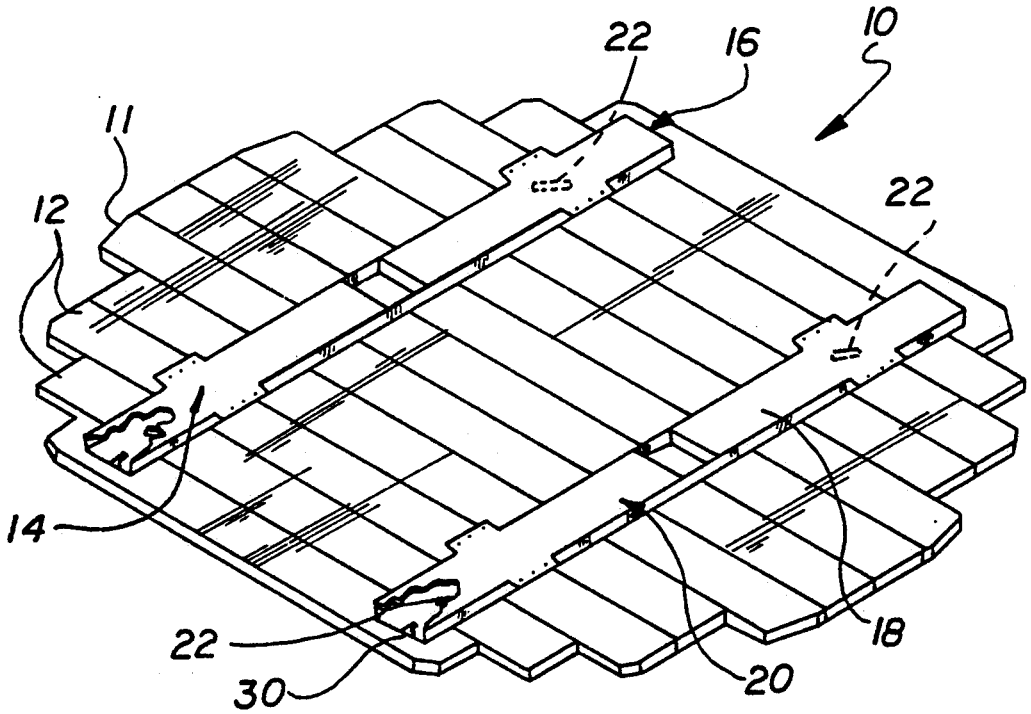
FIG. 2 shows a partially fragmented array antenna constructed in accordance with the present teachings.

FIG. 2 shows a partially fragmented slot coupled planar array antenna 10 constructed in accordance with the teachings of the present invention. The design and construction of the antenna 10 is the same as that of a conventional antenna with the exception that the folded sections 24' are eliminated by the use of L-shaped coupling slots 30. The L-shaped coupling slots 30 are located $k_g/2$ beyond the first and last tilted coupling slots 22 (all but one of which are shown in phantom). This location is made possible by the fact that the L-shaped coupling slots allow the short to be placed at the L-shaped slot. This also permits the L-shaped slot to replace the tapered section 26'.

Figure 3:
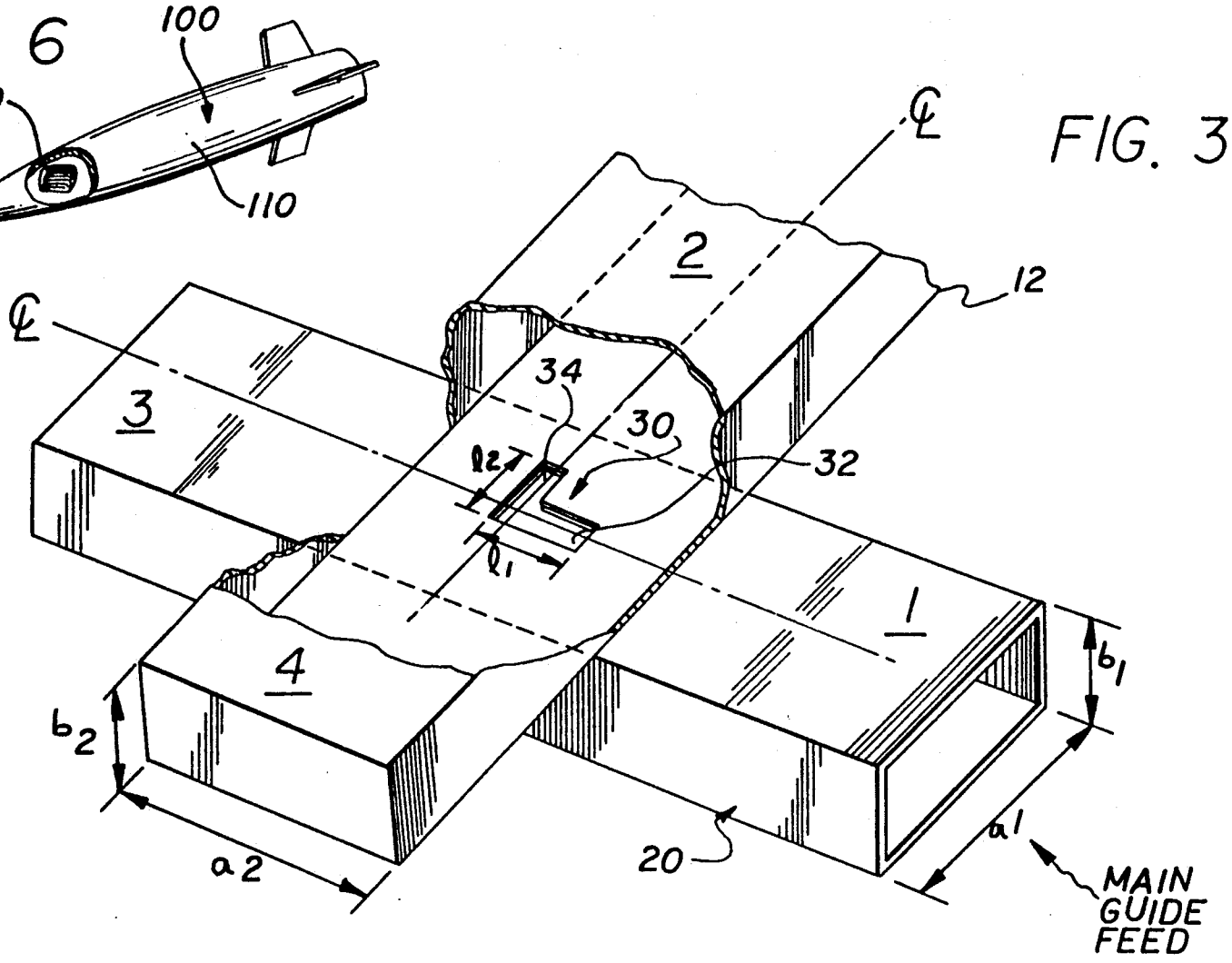
FIG. 3 is a fragmented view of the array antenna of FIG. 2 partially in section, showing the feed waveguide, the radiating waveguide and an L-shaped coupling slot therebetween.

As shown more clearly in the fragmented view, partially in section, of FIG. 3, the L-shaped coupling slot 30 has a first portion 32 parallel to the longitudinal axis of the feed waveguide 20 on the centerline thereof. The coupling slot 30 has a second portion 34 orthogonal to the first portion 32 which is parallel to the longitudinal axis of the radiating waveguide 12 and on the centerline thereof.

The L-shaped slot is a series element because the transverse portion of the slot is a series element and the centered longitudinal part is a parasitic element which satisfies the resonant length condition. Therefore the L-shaped coupling slot is a series/series coupling slot. The centered longitudinal parasitic element does not contribute to the forward and backward scattering of the $TE_{10}$ mode in the waveguide but serves to satisfy the resonant length condition of the L-shaped slot. The simultaneous resonance allows control of the excitation amount and the placement of the short at the slot. The amount of coupling or excitation can be controlled by varying the ratio of the lengths of the first and second portions 32 and 34 of the slot as per a particular application.

The dimensions are chosen for a desired coupling at the operating frequency of interest. For example, typical dimensions for an L-shaped coupling slot, constructed in accordance with the present teachings, are shown below:

$a_1=a_2=0.9''$
$b_1=b_2=0.2''$
$l_1=0.465''$
$l_2=0.245''$
slot width=0.03"
operating frequency=9.13 Ghz.

Figure 4:
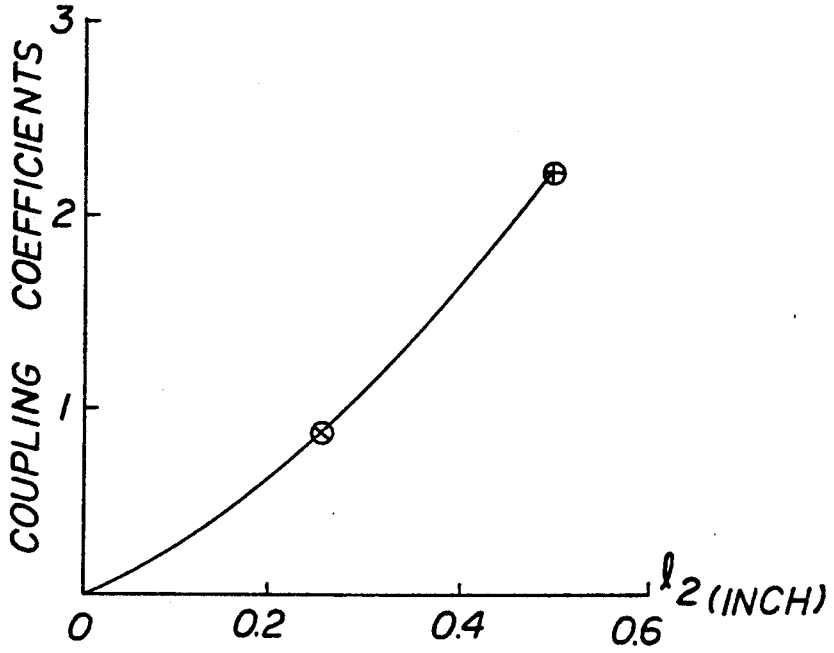
FIG. 4 shows a graph of typical coupling coefficients of the L-shaped coupling slot versus the transverse slot length thereof.

The fact that the transmission coefficient $S_{12}$, between port 1 and port 2, is of the same magnitude and phase as the transmission coefficient $S_{14}$, between port 1 and port 4, indicates that the L-shaped slot is a good series/series coupling slot. The resonant slot length $l_{res}=l_1+l_2$ remains constant for a given frequency. However, the coupling amount increases as the transverse slot length $l_2$ increases. This is illustrated in FIG. 4 which shows a graph of typical coupling coefficients of the L-shaped coupling slot 30 versus the transverse slot length $L_2$ thereof.

Figure 5:
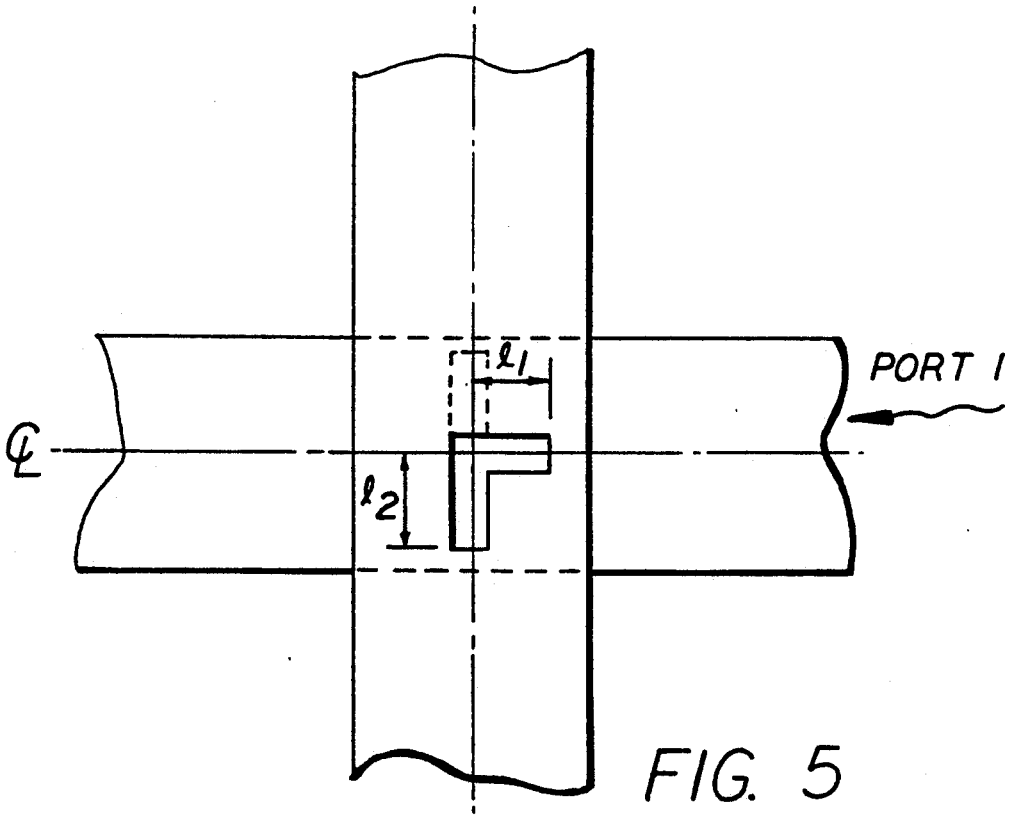
FIG. 5 is a schematic diagram of the L-shaped coupling slot in relation to a radiating waveguide and a feed waveguide in accordance with the teachings of the present invention.

It should be noted that the phase of the energy radiating from the radiating guide 12 would be changed 180 degrees by rotating the $l_2$ arm of the L-shaped slot 30 about the centerline of the feed waveguide 20 as illustrated in phantom in the schematic diagram of FIG. 5.

Figure 6:
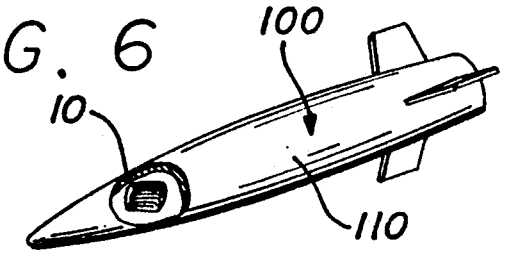
FIG. 6 is a partially fragmented perspective view of a missile implemented with the array antenna of the present invention.

In a typical application, the antenna 10 of the present invention would be implemented in a missile 100 as shown in the fragmented perspective view of FIG. 6. The missile 100 includes a housing 110 about a frame not shown. Also not shown but included are conventional propulsion and guidance systems.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. An array antenna comprising:

a first waveguide, having a longitudinal axis along a centerline thereof, and a second waveguide, having a longitudinal axis along a centerline thereof, and mounted relative to said first waveguide with its longitudinal centerline orthogonal to the longitudinal centerline of said first waveguide, and coupled to said first waveguide by an L-shaped coupling slot, said coupling slot having a first portion located parallel to and along the centerline of said first waveguide and a second portion located parallel to and along the centerline of said second waveguide.

2. An array antenna comprising:

an array of radiating waveguides, each radiating waveguide having a longitudinal axis along a centerline thereof and a feed waveguide, orthogonal to said radiating waveguides, having a longitudinal axis along a centerline thereof, and coupled to at least one of said radiating waveguides by an L-shaped coupling slot, said coupling slot having a first portion substantially orthogonal to a second portion thereof, said first portion of said L-shaped slot being on the centerline of said feed waveguide and parallel to the longitudinal axis thereof and said second portion of said L-shaped slot being on the centerline of an associated radiating waveguide and parallel to the longitudinal axis thereof.

3. A method for designing a planar slot coupled array antenna including the steps of:

a) providing an L-shaped slot in a common broadwall between a radiating waveguide and a feed waveguide, said slot having a first portion substantially orthogonal to a second portion thereof and located such that said first portion lies parallel to and along a centerline of said radiating waveguide and said second portion lies along, and parallel to a centerline of said feed waveguide; and b) sizing the length of the first portion and the length of the second portion to control the excitation of said slot.

4. A missile comprising:

a housing;

an array antenna mounted within said housing, said antenna including:

a first waveguide, having a longitudinal axis along a centerline thereof, and a second waveguide, having a longitudinal axis along a centerline thereof, and mounted relative to said first waveguide with its longitudinal centerline orthogonal to the longitudinal centerline of said first waveguide, and coupled to said first waveguide by an L-shaped coupling slot, said coupling slot having a first portion located parallel to and along the centerline of said first waveguide and a second portion located parallel to and along the centerline of said second waveguide.

5. An array antenna comprising:

an array of radiating waveguides, each waveguide having a longitudinal axis along the centerline thereof, and a feed waveguide having a longitudinal axis along a centerline thereof and coupled to at least one of said radiating waveguides by an L-shaped coupling slot, said coupling slot being colocated with a short circuit element located at an end of said feed waveguide and having a first portion substantially orthogonal to a second portion thereof, said first portion of each slot being on the centerline of said feed waveguide and parallel to the longitudinal axis thereof and said second portion of each slot being on the centerline of a radiating waveguide and parallel to the longitudinal axis thereof.

6. An array antenna comprising:

an array of radiating waveguides, each waveguide having a longitudinal axis along the centerline thereof, and a feed waveguide having a longitudinal axis along a centerline thereof and coupled to at least one of said radiating waveguides by an L-shaped coupling slot located at a short circuit element therein, said coupling slot having a first portion substantially orthogonal to a second portion thereof, said first portion of each slot being on the centerline of said feed waveguide and parallel to the longitudinal axis thereof and said second portion of each slot being on the centerline of a radiating waveguide and parallel to the longitudinal axis thereof.

7. An array antenna comprising:

an array of radiating waveguides, each waveguide having a longitudinal axis along the centerline thereof, and a feed waveguide having a longitudinal axis along a centerline thereof and coupled to at least one of said radiating waveguides by an L-shaped coupling slot, said coupling slot being colocated with a short circuit element located on an end of said feed waveguide and having a first portion substantially orthogonal to a second portion thereof, said first portion of each slot being on the centerline of said feed waveguide and parallel to the longitudinal axis thereof and said second portion of each slot being on the centerline of a radiating waveguide and parallel to the longitudinal axis thereof.

* * * * *